US010590505B2

(12) United States Patent
Kohsaka et al.

(10) Patent No.: US 10,590,505 B2
(45) Date of Patent: Mar. 17, 2020

(54) HIGH STRENGTH STEEL SHEET AND METHOD FOR MANUFACTURING THE SAME

(71) Applicant: JFE STEEL CORPORATION, Tokyo (JP)

(72) Inventors: Noriaki Kohsaka, Fukuyama (JP); Yoshimasa Funakawa, Chiba (JP); Michitaka Sakurai, Fukuyama (JP); Yoshikazu Suzuki, Fukuyama (JP)

(73) Assignee: JFE STEEL CORPORATION, Tokyo (JP)

( * ) Notice: Subject to any disclaimer, the term of this patent is extended or adjusted under 35 U.S.C. 154(b) by 324 days.

(21) Appl. No.: 15/554,591

(22) PCT Filed: Jan. 14, 2016

(86) PCT No.: PCT/JP2016/000156

§ 371 (c)(1),
(2) Date: Aug. 30, 2017

(87) PCT Pub. No.: WO2016/139876

PCT Pub. Date: Sep. 9, 2016

(65) Prior Publication Data

US 2018/0237880 A1 Aug. 23, 2018

(30) Foreign Application Priority Data

Mar. 3, 2015 (JP) ..... 2015-041220

(51) Int. Cl.

| | |
|---|---|
| ***C21D 9/46*** | (2006.01) |
| ***C21D 8/02*** | (2006.01) |
| ***C21D 6/00*** | (2006.01) |
| ***C22C 38/60*** | (2006.01) |
| ***C22C 38/14*** | (2006.01) |
| ***C22C 38/12*** | (2006.01) |
| ***C22C 38/06*** | (2006.01) |
| ***C22C 38/04*** | (2006.01) |
| ***C22C 38/02*** | (2006.01) |
| ***C23C 2/06*** | (2006.01) |
| ***C23C 2/28*** | (2006.01) |
| ***C23C 2/40*** | (2006.01) |
| ***C22C 38/00*** | (2006.01) |
| ***C22C 18/04*** | (2006.01) |
| *C22C 18/00* | (2006.01) |

(52) U.S. Cl.

CPC ..... *C21D 9/46* (2013.01); *C21D 6/005* (2013.01); *C21D 6/008* (2013.01); *C21D 8/0205* (2013.01); *C21D 8/0226* (2013.01); *C21D 8/0236* (2013.01); *C21D 8/0263* (2013.01); *C21D 8/0278* (2013.01); *C22C 18/04* (2013.01); *C22C 38/00* (2013.01); *C22C 38/001* (2013.01); *C22C 38/002* (2013.01); *C22C 38/005* (2013.01); *C22C 38/008* (2013.01); *C22C 38/02* (2013.01); *C22C 38/04* (2013.01); *C22C 38/06* (2013.01); *C22C 38/12* (2013.01); *C22C 38/14* (2013.01); *C22C 38/60* (2013.01); *C23C 2/06* (2013.01); *C23C 2/28* (2013.01); *C23C 2/40* (2013.01); *C22C 18/00* (2013.01)

(58) Field of Classification Search

None

See application file for complete search history.

(56) References Cited

U.S. PATENT DOCUMENTS

| | | | |
|---|---|---|---|
| 2011/0005643 | A1 | 1/2011 | Murakami et al. |
| 2012/0009434 | A1 | 1/2012 | Hata et al. |

FOREIGN PATENT DOCUMENTS

| | | | |
|---|---|---|---|
| CA | 2 767 206 | A1 | 2/2011 |
| CA | 2 850 195 | A1 | 4/2013 |
| CA | 2 947 382 | A1 | 10/2015 |
| CA | 2 907 507 | C | 9/2017 |
| CN | 102348823 | A | 2/2012 |
| CN | 103097566 | A | 5/2013 |
| EP | 2 546 368 | A1 | 1/2013 |
| EP | 2617849 | A1 | 7/2013 |
| EP | 2 757 171 | A1 | 7/2014 |
| JP | 2006-183140 | A | 7/2006 |
| JP | 2008-266778 | A | 11/2008 |
| JP | 2009-209450 | A | 9/2009 |
| JP | 2010-037652 | A | 2/2010 |
| JP | 2013-227657 | A | 11/2013 |
| JP | 2014-29021 | A | 2/2014 |

(Continued)

OTHER PUBLICATIONS

Nov. 19, 2018 Office Action issued in Korean Application No. 2017-7024006.

(Continued)

*Primary Examiner* — Xiaowei Su

(74) *Attorney, Agent, or Firm* — Oliff PLC

(57) ABSTRACT

A high-strength steel sheet having a composition containing C: 0.09% to 0.17%, Si: 0.6% to 1.7%, Mn: 3.5% or less, P: 0.03% or less, S: 0.005% or less, Al: 0.08% or less, N: 0.006% or less, Ti: 0.05% or less, and B: 0.0002% to 0.0030% on a mass basis, the remainder being Fe and inevitable impurities. The steel sheet also has a microstructure containing less than 20% (including 0%) of a ferrite phase, 75% or more (including 100%) of a tempered martensite phase, 10% or less (including 0%) of an untempered martensite phase, and less than 5% (including 0%) of a retained austenite phase in terms of area fraction. The tempered martensite phase has a Vickers hardness of 280 to 340 and a tensile strength of 950 MPa to 1,120 MPa.

11 Claims, No Drawings

(56) References Cited

FOREIGN PATENT DOCUMENTS

| | | | |
|---|---|---|---|
| JP | 2014-196557 | A | 10/2014 |
| KR | 2010-0105799 | A | 9/2010 |

OTHER PUBLICATIONS

Jul. 27, 2018 Office Action issued in Canadian Application No. 2,972,741.
Jan. 22, 2019 Office Action issued in Chinese Patent Application No. 201680013343.9.
May 30, 2018, Office Action issued in Chinese Patent Application No. 201680013343.9.
Apr. 1, 2016 Search Report issued in International Patent Application No. PCT/JP2016/000156.
May 3, 2018 Extended European Search Report Issued in European Patent Application No. 16758577.7.

HIGH STRENGTH STEEL SHEET AND METHOD FOR MANUFACTURING THE SAME

TECHNICAL FIELD

The present disclosure relates to a high-strength steel sheet and a method for manufacturing the same. A high-strength steel sheet according to the present disclosure is useful for use in automotive members.

BACKGROUND ART

In recent years, from the viewpoint of global environmental protection, improvements in automotive fuel efficiency have been directed in the whole automotive industry for the purpose of regulating $CO_2$ emissions. Automotive weight reduction by the gauge reduction of parts used is most effective in improving the fuel efficiency of automobiles. Therefore, in recent years, the consumption of high-strength steel sheets for automotive parts has been increasing.

On the other hand, the formability of steel sheets tends to deteriorate with an increase in strength. Therefore, steel sheet having excellent formability in addition to high strength are demanded. A steel sheet which is short of stretch flangeability cannot be applied to underbody parts or the like needing stretch flangeability. The development of a steel sheet having high strength and stretch flangeability is essential to lighten automotive parts and the like. Various techniques focused on stretch flangeability have been proposed for high-strength cold-rolled steel sheets and hot-dip coated steel sheets.

For example, Patent Literature 1 describes that a high-strength galvanized steel sheet excellent in formability is obtained. The high-strength galvanized steel sheet has a composition containing C: 0.05% to 0.3%, Si: more than 0.6% to 2.0%, and Mn: 0.50% to 3.50% on a mass basis and a microstructure containing a ferrite phase, a tempered martensite phase, a tempered bainite phase, and a bainite phase, wherein the area fraction of the ferrite phase is 20% or more, the sum of the area fractions of the tempered martensite, tempered bainite, and bainite phases is 10% or more, and the sum of the area fractions of the ferrite, tempered martensite, tempered bainite, and bainite phases is 90% or more.

Patent Literature 2 describes that a high-strength galvanized steel sheet, excellent in workability, having a TS of 1,200 MPa or more and a hole expansion ratio of 50% or more is obtained. The high-strength galvanized steel sheet has a composition containing C: 0.05% to 0.5%, Si: 0.01% to 2.5%, and Mn: 0.5% to 3.5% on a mass basis and a microstructure containing a ferrite phase, a martensite phase, a tempered martensite phase and a retained austenite phase, wherein the area fraction of the ferrite phase is 0% to 10%, the area fraction of the martensite phase is 0% to 10%, the area fraction of the tempered martensite phase is 65% to 95% and the ratio of the retained austenite phase determined by X-ray diffractometry is 5% to 20%.

CITATION LIST

Patent Literature

PTL 1: Japanese Unexamined Patent Application Publication No. 2008-266778

PTL 2: Japanese Unexamined Patent Application Publication No. 2009-209450

SUMMARY

Technical Problem

However, in a technique proposed in Patent Literature 1, it is difficult to obtain a steel sheet with a tensile strength of 900 MPa or more because a large amount of a soft ferrite phase is contained. Even in a steel sheet with a tensile strength of 950 MPa or more, the difference in hardness between microstructures is large because of the formation of a ferrite phase and therefore it is difficult to steadily obtain good hole expansion ratio.

In a technique proposed in Patent Literature 2, the control of the hardness of the tempered martensite phase and the formation of the retained austenite phase is inadequate and good hole expansion ratio cannot be obtained. In particular, in Plated Steel Sheet Nos. 25 and 26, although good total elongation is obtained, voids are caused during punching because the hardness of a tempered martensite phase is excessively high and a large amount of a retained austenite phase is contained. A hole expansion ratio required in the present disclosure cannot be obtained because of the voids.

The present disclosure has been made in view of such circumstances. It is an object of the present disclosure to provide a high-strength steel sheet, excellent in stretch flangeability, having a tensile strength of 950 MPa to 1,120 MPa and a method for manufacturing the same.

Solution to Problem

As a result of intensively investigating requirements for a high-strength steel sheet having a tensile strength of 950 MPa to 1,120 MPa and good stretch flangeability, it has become clear that a steel sheet needs to have a microstructure in which tempered martensite is a primary phase (an area fraction of 75% or more in the microstructure of the steel sheet) and the tempered martensite phase needs to have appropriate hardness. Furthermore, in order to obtain a high-strength steel sheet according to the present disclosure, tempering conditions for changing the hardness and ductility of a tempered martensite phase are preferably controlled.

(1) In steps for manufacturing steel sheets, the uneven distribution of elements is preferably minimized. In steps for manufacturing a steel sheet, the uneven distribution of an element may possibly cause the formation of a ferrite phase or retained austenite phase; hence, the hardness of a tempered martensite phase may possibly vary. The inventors have found that one of causes of the uneven distribution of the element is the insufficient diffusion of the element due to ferrite transformation during hot rolling and heating to higher than the $Ac_1$ transformation temperature in an annealing step. From the viewpoint of sufficiently diffusing an element in steel, the coiling temperature of a hot-rolled steel plate is preferably the temperature at which bainite transformation occurs. Next, the uneven distribution of an element, including the partition, concentration distribution, and segregation of a solute element (C, Mn, or Si), in a reverse-transformed austenite phase obtained by annealing is preferably minimized. Thus, sufficient heating is preferably performed at high temperature in an annealing step.

(2) In the case of performing rapid cooling after soaking in an annealing step, it is preferable that ferrite transformation is suppressed and martensite transformation is sufficiently completed. From this viewpoint, an alloying element, the cooling rate, and the cooling stop temperature are preferably controlled.

(3) Among conditions for tempering a formed martensite phase, the heating temperature and time are preferably controlled. In an actual manufacturing process, isothermal holding is not necessarily performed; hence, the hardness of a tempered martensite phase is preferably controlled in view of the influence of the change in temperature of a steel sheet.

The present disclosure has been completed on the basis of the above findings and exemplary disclosed embodiments are summarized below.

[1] A high-strength steel sheet has a composition containing C: 0.09% to 0.17%, Si: 0.6% to 1.7%, Mn: 3.5% or less, P: 0.03% or less, S: 0.005% or less, Al: 0.08% or less, N: 0.006% or less, Ti: 0.05% or less, and B: 0.0002% to 0.0030% on a mass basis, the remainder being Fe and inevitable impurities, and also has a steel sheet microstructure containing less than 20% (including 0%) of a ferrite phase, 75% or more (including 100%) of a tempered martensite phase, 10% or less (including 0%) of an untempered martensite phase, and less than 5% (including 0%) of a retained austenite phase in terms of area fraction. The tempered martensite phase has a Vickers hardness of 280 to 340 and a tensile strength of 950 MPa to 1,120 MPa.

[2] In the high-strength steel sheet specified in Item [1], the composition further contains one or more selected from V: 0.01% to 0.1% and Mo: 0.01% to 0.2% on a mass basis.

[3] In the high-strength steel sheet specified in Item [1] or [2], the composition further contains one or more selected from an REM, Sn, Sb, Mg, and Ca totaling 0.1% or less on a mass basis.

[4] In the high-strength steel sheet specified in any one of Items [1] to [3], the high-strength steel sheet is a hot-dip coated steel sheet or an alloyed hot-dip coated steel sheet.

[5] A method for manufacturing a high-strength steel sheet includes a hot rolling step of heating steel having the composition specified in any one of Items [1] to [3] to 1,100° C. to 1,350° C., performing hot rolling including rough rolling and finish rolling, and performing coiling at a coiling temperature of 580° C. or lower after finish rolling at a finishing delivery temperature of 800° C. or higher; a cold rolling step of performing cold rolling; an annealing step of performing heating at an average heating rate of 2.0° C./s or less in a temperature range from ($Ac_1$ transformation temperature+10)° C. to ($Ac_3$ transformation temperature−20)° C., performing holding for 60 seconds or more in the temperature range from ($Ac_1$ transformation temperature 10)° C. to ($Ac_3$ transformation temperature−20)° C., performing holding for 120 seconds or more in a temperature range not lower than ($Ac_3$ transformation temperature−20)° C., performing cooling at an average cooling rate of 20° C./s or more in a temperature range from ($Ac_3$ transformation temperature−20)° C. to the Ms transformation temperature, and performing further cooling to a temperature of below (Ms transformation temperature−200)° C.; and a tempering step of performing reheating in a temperature range from 400° C. to 600° C. under such conditions that heating corresponding to 500° C. is performed for 60 seconds or more.

[6] The method for manufacturing the high-strength steel sheet specified in Item [5] further includes a hot dipping step of performing hot dipping.

[7] The method for manufacturing the high-strength steel sheet specified in Item [6] further includes an alloying step of performing alloying.

In the present disclosure, high strength means a tensile strength (TS) of 950 MPa to 1,120 MPa. In the present disclosure, a high-strength steel sheet is a cold-rolled steel sheet or a hot-dip coated steel sheet. The term "hot-dip coated steel sheet" includes not only hot-dip coated steel sheets but also alloyed hot-dip coated steel sheets. When a hot-dip coated steel sheet and an alloyed hot-dip coated steel sheet need to be separately explained, these steel sheets are separately described.

Advantageous Effects

According to the present disclosure, a high-strength steel sheet having a tensile strength of 950 MPa to 1,120 MPa and excellent stretch flangeability is obtained. The high-strength steel sheet according to the present disclosure is suitable for use in automotive structural parts and the like. The high-strength steel sheet according to the present disclosure has significant effects such as the reduction in weight of automotive parts and the improvement in reliability thereof.

DESCRIPTION OF EMBODIMENTS

Exemplary embodiments of the present disclosure are described below in detail. First, reasons for limiting the composition according to the present disclosure are described. The unit "%" used to express the composition below refers to "mass percent" unless otherwise specified.

C: 0.09% to 0.17%

C increases the hardness of a martensite phase, and has hardenability to suppress ferrite transformation, and has hardenability. When the content of C is below 0.09%, the area fraction of a ferrite phase is 20% or more and the hardness of a tempered martensite phase is insufficient; hence, a steel sheet with a tensile strength of 950 MPa or more is not obtained. However, when the content of C is above 0.17%, the martensite transformation temperature (Ms transformation temperature) decreases excessively; hence, the formation of an untempered martensite phase and a retained austenite phase increases and a reduction in stretch flangeability becomes obvious. Therefore, the content of C is set to 0.09% to 0.17%. The lower limit of the content of C is preferably 0.10% or more. The upper limit of the content of C is preferably 0.16% or less.

Si: 0.6% to 1.7%

Si is an element that contributes to an increase in strength by solid solution strengthening. In order to obtain a tensile strength of 950 MPa or more, the content of Si needs to be 0.6% or more. On the other hand, Si has a negative influence that Si shortens the latent period of ferrite transformation to promote ferrite transformation. From the viewpoint of suppressing the formation of the ferrite phase, the content of Si is set to 1.7% or less. The lower limit of the content of Si is preferably 0.8% or more. The upper limit of the content of Si is preferably 1.6% or less.

Mn: 3.5% or less

When the content of Mn is above 3.5%, a negative influence on castability becomes obvious and manufacture is difficult. Therefore, the upper limit of the content of Mn is set to 3.5%, The upper limit thereof is preferably 3.3% or less. On the other hand, Mn contributes to an increase in strength by solid solution strengthening and has the effect of lowering the $Ac_3$ transformation temperature to promote the homogenization of the microstructure of a steel sheet and the effect of delaying the start of ferrite transformation. From this viewpoint, the content of Mn is preferably 2.5% or more. The content of Mn is more preferably 2.6% or more.

P: 0.03% or less

P is an element which segregates at grain boundaries to reduce the punchability and which has a negative influence on the stretch flangeability. Thus, P is preferably minimized. In the present disclosure, in order to avoid the above problem, the content of P is set to 0.03% or less. The content of P is preferably 0.02% or less and may be 0%. From the viewpoint of production costs, the content of P is preferably 0.0005% or more.

S: 0.005% or less

S is present in steel in the form of an inclusion such as MnS. The inclusion has a shape elongated in a rolling direction by hot rolling and cold rolling. Such a shape is likely to be the origin of the formation of voids and has a negative influence on the stretch flangeability. Thus, in the present disclosure, the content of S is preferably minimized and is set to 0.005% or less. The content of S is preferably 0.003% or less and may be 0%. From the viewpoint of production costs, the content of S is preferably 0.0001% or more.

Al: 0.08% or less

In the case where Al is added as a deoxidizer in the stage of steelmaking, 0.02% or more Al is preferably contained in the steel sheet. However, when the content of Al is more than 0.08%, a negative influence on the stretch flangeability becomes obvious due to inclusions such as alumina. Thus, the content of Al is set to 0.08% or less. The content of Al is preferably 0.07% or less.

N: 0.006% or less

N is an element causing aging. Since the stretch flangeability is reduced by aging, the content of N is preferably minimized and is capped to 0.006%. The content of N is preferably 0.005% or less and may be 0%. From the viewpoint of production costs, the content of N is preferably 0.0002% or more.

Ti: 0.05% or less

When more than 0.05% Ti is contained, coarse Ti carbides are formed, thereby causing a reduction in flangeability. Therefore, the content of Ti is set to 0.05% or less and is preferably 0.04% or less. Solute N is likely to diffuse in the steel sheet and causes aging. Since the stretch flangeability is deteriorated by aging, the amount of solute N needs to be reduced. Ti combines with N in the stage of steelmaking to form nitrides and therefore can remove the negative influence of aging. Since N is an inevitably contained element, 0.005% or more Ti is preferably contained. The content of Ti is more preferably 0.01% or more.

B: 0.0002% to 0.0030%

B has the effect of significantly delaying the start of ferrite transformation and is an element essential in the present disclosure. In order to obtain this effect, 0.0002% or more B needs to be contained. The content of B is preferably 0.0005% or more. However, containing more than 0.0030% B saturates the above effect and causes deterioration in workability. Therefore, the upper limit of the content of B is set to 0.0030%. The content of B is preferably 0.0025% or less.

The above is a basic composition in the present disclosure. Elements below may be further contained in addition to the basic composition.

One or more selected from V: 0.01% to 0.1% and Mo: 0.01% to 0.2%

V is an element which is precipitated in the form of carbides in the course of tempering the martensite phase and which has the effect of increasing the strength of the steel sheet. Mo increases the temper softening resistance of the martensite phase and, as well as V, has the effect of increasing the strength of the steel sheet. In order to obtain these effects, when each element is contained, the content thereof is preferably at least 0.01% or more. However, when more than 0.1% V is contained or more than 0.2% Mo is contained, the stretch flangeability may possibly be reduced. Therefore, the upper limit of the content of V and that of Mo are preferably 0.1% and 0.2%, respectively. The lower limit of the content of V is more preferably 0.02% or more. The upper limit of the content of V is more preferably 0.08% or less. The lower limit of the content of Mo is more preferably 0.02% or more. The upper limit of the content of Mo is more preferably 0.15% or less. When both elements, V and Mo, are contained, the sum of the contents thereof is preferably 0.15% or less.

One or more selected from REM, Sn, Sb, Mg, and Ca totaling 0.1% or less

Containing one or more selected from an REM, Sn, Sb, Mg, and Ca totaling more than 0.1% may possibly deteriorate the workability to cause deterioration in stretch flangeability. Therefore, when one or more selected from the REM, Sn, Sb, Mg, and Ca are contained, the upper limit of the content thereof is preferably set to 0.1% and more preferably 0.05% or less. On the other hand, these elements contribute to an improvement in stretch flangeability by spheroidizing inclusions or improving surface properties of the steel sheet. As inclusions are more spherical, the concentration of stress around the inclusions is lower and therefore voids are more unlikely to be caused. Furthermore, as surface properties of the steel sheet are better, the probability of cracking occurring in surfaces of the steel sheet is lower and therefore the stretch flangeability is more likely to be improved. In order to obtain the above effects, when one or more selected from the REM, Sb, Mg, and Ca are contained, the content thereof is preferably 0.0005% or more and more preferably 0.001% or more.

Components other than the above are Fe and inevitable impurities.

The microstructure of a steel sheet according to the present disclosure is described below. The present disclosure has a steel sheet microstructure in which a tempered martensite phase is a primary phase. The area fraction of the tempered martensite phase, which is the primary phase, is 75% or more. Thus, the microstructure of the steel sheet according to the present disclosure may contain the tempered martensite phase only. The microstructure of the steel sheet according to the present disclosure may contain a ferrite phase, an untempered martensite phase, a retained austenite phase, and the like in addition to the tempered martensite phase.

Area fraction of ferrite phase: less than 20% (including 0%)

The ferrite phase is a softer microstructure as compared to the tempered martensite phase. When 20% or more of the ferrite phase is contained, the influence of a reduction in stretch flangeability due to the difference in hardness between the tempered martensite phase and the ferrite phase is not negligible. The solubility of an element at high temperature in an annealing step differs between the ferrite phase and an austenite phase. This causes the promotion of the uneven distribution of the element. In the present disclosure, the area fraction of the ferrite phase needs to be less than 20%. The area fraction of the ferrite phase is preferably 15% or less and is more preferably reduced to 0%.

Area fraction of tempered martensite phase: 75% or more (including 100%)

The tempered martensite phase is better in stretch flangeability than the untempered martensite phase and is higher in strength than the ferrite phase. Therefore, high strength and good stretch flangeability can be obtained together using the tempered martensite phase. In order to obtain a tensile strength of 950 MPa or more as required in the present disclosure, the tempered martensite phase needs to be at least 75% or more. In order to steadily obtain good stretch flangeability, the area fraction of the tempered martensite phase is 85% or more.

Area fraction of untempered martensite phase: 10% car less (including 0%)

The untempered martensite phase is a microstructure in which no carbides are precipitated in grains or at grain boundaries. However, the tempered martensite phase is a microstructure in which carbides are precipitated and is identified by whether carbides are present. The untempered martensite phase is very hard and therefore causes the difference in hardness between microstructures, thereby causing a reduction in stretch flangeability. Thus, the area fraction of the untempered martensite phase is preferably minimized and needs to be 10% or less. The area fraction of the untempered martensite phase is preferably 5% or less and is more preferably reduced to 0%.

Area fraction of retained austenite phase: less than 5% (including 0%)

The retained austenite phase is converted into a microstructure with high hardness by strain-induced transformation during punching. Therefore, the retained austenite phase causes the formation of voids during punching to negatively affect the stretch flangeability. Thus, the area fraction of the retained austenite phase needs to be less than 5%. The area fraction of the retained austenite phase is preferably 4% or less.

Other microstructures include a bainite phase, a pearlite phase, and the like. The case where these microstructures are formed leads to a mixed microstructure with the tempered martensite phase to increase the difference in hardness between microstructures. In order to reduce the difference in hardness between microstructures, the sum of the area fractions of the bainite phase, the pearlite phase, and the like other than the ferrite phase, the tempered martensite phase, the untempered martensite phase, and the retained austenite phase is preferably set to 3% or less and more preferably 0%. In the present disclosure, it is very difficult to distinguish between the tempered martensite phase and the bainite phase by microstructural observation. Therefore, the presence or absence of bainite transformation and the transformation rate may be determined from a transformation expansion curve. In a manufacturing method below, bainite transformation occurs in the course of cooling after soaking in an annealing step. The presence or absence of bainite transformation is judged from the presence or absence of transformation expansion in the course of cooling. In the case where transformation expansion is observed, rapid cooling is performed from a temperature 10° C. higher than the Ms transformation temperature to room temperature and the area fraction of the martensite phase, the area fraction of the ferrite phase, and the area fraction of the bainite phase may be checked.

The area fraction of the microstructure of the steel sheet according to the present disclosure is determined by a method described in EXAMPLES below.

The Vickers hardness of the tempered martensite phase is 280 to 340. When the Vickers hardness of the tempered martensite phase is below 280, a tensile strength of 950 MPa or more is not steadily obtained. However, when Vickers hardness of the tempered martensite phase is above 340, deterioration in stretch flangeability becomes obvious. Therefore, the Vickers hardness of the tempered martensite phase ranges from 280 to 340.

In the present disclosure, the tensile strength is 950 MPa to 1,120 MPa. Among members required to have good stretch flangeability, those having a tensile strength of 950 MPa or more are increasingly used. In the present disclosure, the tensile strength has been designed to 950 MPa or more. On the other hand, in the present disclosure, it is difficult to obtain a steel sheet with a tensile strength of more than 1,120 MPa, Even if such a steel sheet is obtained, the stretch flangeability thereof is not within a range required in the present disclosure. From the above, the tensile strength ranges from 950 MPa to 1,120 MPa.

In the present disclosure, the Vickers hardness of the tempered martensite phase and the tensile strength of the steel sheet are determined by methods described in EXAMPLES below.

A high-strength steel sheet according to the present disclosure is a cold-rolled steel sheet or a hot-dip coated steel sheet. In the manufacture of the hot-dip coated steel sheet, a hot-dip coating layer can be appropriately formed by a known technique. The hot-dip coated steel sheet is, for example, a hot-dip coated steel sheet, an alloyed hot-dip coated steel sheet, or the like. The hot-dip coated steel sheet is preferably a galvanized steel sheet. A coated layer of the hot-dip coated steel sheet may be alloyed. The hot-dip coating layer can be appropriately alloyed by a known technique.

The thickness of the high-strength steel sheet according to the disclosure is not particularly limited and is preferably 1.0 mm to 2.0 mm. When the high-strength steel sheet includes a coated layer, the thickness thereof is the thickness of a base steel sheet excluding the coated layer.

A manufacturing method according to the present disclosure is described below. The high-strength steel sheet according to the present disclosure is preferably manufactured by a manufacturing method below.

The high-strength steel sheet according to the present disclosure is preferably manufactured by a manufacturing method for manufacturing the high-strength steel sheet, the method including a hot rolling step of heating steel (a steel slab) having the above-mentioned composition to 1,100° C. to 1,350° C., performing hot rolling including rough rolling and finish rolling, and performing coiling at a coiling temperature of 580° C. or lower after finish rolling at a finishing delivery temperature of 800° C. or higher; a cold rolling step of performing cold rolling; an annealing step of performing heating at an average heating rate of 2.0° C./s or less in a temperature range from ($Ac_1$ transformation temperature+10)° C. to ($Ac_3$ transformation temperature−20)° C., performing holding for 60 seconds or more in the temperature range from ($Ac_1$ transformation temperature+10)° C. to ($Ac_3$ transformation temperature−20)° C., performing holding for 120 seconds or more in a temperature range not lower than ($Ac_3$ transformation temperature−20)° C., performing cooling at an average cooling rate of 20° C./s or more in a temperature range from ($Ac_3$ transformation temperature−20) to the Ms transformation temperature, and performing further cooling to a temperature of below (Ms transformation temperature−200)° C.; and a tempering step of performing reheating in a temperature range from 400° C. to 600° C. under such conditions that heating corresponding to 500° C. is performed for 60 seconds or more.

In the present disclosure, a method for producing steel is not particularly limited and a known production method using a converter, an electric furnace, or the like can be used. Secondary smelting may be performed in a vacuum degassing furnace. Thereafter, a slab that is the steel is preferably manufactured by a continuous casting process because of productivity and quality issues. The slab may be prepared by a known casting process such as an ingot casting-blooming process or a thin slab continuous casting process.

(Hot Rolling Step)

In the hot rolling step described below, the temperature is the surface temperature of the steel or a steel plate.

Temperature of steel: 1,100° C. to 1,350° C.

The steel obtained as described above is roughly rolled and is finish-rolled. In the present disclosure, the steel is heated to 1,100° C. to 1,350° C. prior to rough rolling such that substantially a homogeneous austenite phase spreads over the whole steel. When the temperature of the steel is below 1,100° C., hot rolling cannot be completed at a finish rolling temperature of 800° C. or higher. However, when the temperature of the steel is above 1,350° C., scale biting impairs surface properties of a hot-rolled steel plate. Therefore, the temperature of the steel is set to 1,100° C. to 1,350° C. The temperature of the steel is preferably 1,150° C. to 1,300° C., Upon hot-rolling the steel, the steel is usually heated and is then hot-rolled. However, when the cast steel is in a temperature range from 1,100° C. to 1,350° C., the steel may be directly rolled without being heated. Incidentally, rough rolling conditions are not particularly limited.

Finishing delivery temperature: 800° C. or higher

When the finishing delivery temperature is below 800° C., ferrite transformation starts during finish rolling to form a microstructure containing elongated ferrite grains and a mixed grain microstructure containing partially grown ferrite grains and therefore substantially a bainite single-phase microstructure is not obtained in the hot-rolled steel plate. Thus, the finishing delivery temperature is set to 800° C. or higher. The finishing delivery temperature is preferably 840° C. or higher. In the hot-rolled steel plate, a surface portion (a distance of up to 50 μm from a surface) of the steel plate differs in microstructure from a through-thickness central portion thereof in some cases because of the influence of decarburization by scales or the like. In the present disclosure, "substantially a bainite single-phase microstructure" may be that the area fraction of the bainite phase in a range from a one-fourth position to a three-fourths position in a thickness direction is 90% or more.

After finish rolling, cooling is usually performed to just above the coiling temperature by forced cooling. The time from the completion of finish rolling to the start of forced cooling is preferably 5 seconds or less. When the time therefrom is more than 5 seconds, ferrite transformation starts and therefore substantially the bainite single-phase microstructure is not obtained in some cases. The cooling rate due to forced cooling is preferably set to 20° C./s or more in terms of the average cooling rate from the finishing delivery temperature to 580° C. When the cooling rate is less than 20° C./is, ferrite transformation may possibly start.

Coiling temperature: 580° C. or lower

In order to obtain substantially the bainite single-phase microstructure, the coiling temperature is set to 580° C. or lower. Even in martensite transformation rather than bainite transformation, although no negative influence due to the uneven distribution of an element appears, the strength of the steel plate is high and productivity in the cold rolling step deteriorates. Therefore, the coiling temperature is preferably set to not lower than the Ms transformation temperature. In the present disclosure, the Ms transformation temperature is determined from a transformation expansion curve by Work Formaster and the microstructure of an obtained sample by a method described in EXAMPLES below.

(Cold Rolling Step)

In the present disclosure, conditions of the cold rolling step are not particularly limited. From the viewpoint of the shape of a sheet during cold rolling, the cold rolling reduction is set to 40% to 75%.

(Annealing Step)

Heating at an average heating rate of 2.0° C./s or less in a temperature range from ($Ac_1$ transformation temperature+10)° C. to ($Ac_3$ transformation temperature−20)° C. and holding for 60 seconds or more in this temperature range During heating in the annealing step, it is necessary that reverse transformation (ferrite-to-austenite transformation) is allowed to proceed sufficiently and elements are diffused. Therefore, the temperature of a steel sheet and the time during reverse transformation need to be controlled. The $Ac_1$ transformation temperature and the $Ac_3$ transformation temperature are transformation temperatures obtained by measurement in a near-equilibrium state. Therefore, in order to control the behavior of reverse transformation in an actual continuous annealing line or continuous coating line, control is performed at not lower than ($Ac_1$ transformation temperature+10)° C. On the other hand, heating to not lower than the $Ac_3$ transformation temperature is necessary to complete reverse transformation. In the present disclosure, control is performed at not higher than ($Ac_3$ transformation temperature−20)° C. for the purpose of obtaining a steel sheet microstructure in which the area fraction of the ferrite phase is less than 20%. From the viewpoint of obtaining the preferable area fraction of the ferrite phase, control may be performed at not higher than ($Ac_3$ transformation temperature−10)° C. Holding for a short time is insufficient for reverse transformation to proceed, leading to a difficulty in microstructural control. Therefore, the control of the holing (residence) time is necessary. In order to obtain a desired steel sheet microstructure, holding is performed for 60 seconds or more in the temperature range from ($Ac_1$ transformation temperature+10)° C. to ($Ac_3$ transformation temperature−20)° C. The holding time is preferably 80 seconds or more. However, the holding time is preferably 230 seconds or less.

The average heating rate in the temperature range from ($Ac_1$ transformation temperature+10)° C. to ($Ac_3$ transformation temperature−20)° C. is set to 2.0° C./s or less. This is because by heating in the annealing step, reverse transformation is sufficiently promoted and elements are diffused. The average heating rate is preferably 1.5° C./s or less. In the present disclosure, the unit "s" used to express the heating rate and the cooling rate refers to seconds.

Holding for 120 seconds or more in a temperature range not lower than ($Ac_3$ transformation temperature−20)° C.

In order to sufficiently promote reverse transformation, in order to reduce the area fraction of the ferrite phase, and in order to relieve the uneven distribution of an element, soaking is performed in such a manner that holding is performed at a steel sheet temperature of not lower than ($Ac_3$ transformation temperature−20)° C. for 120 seconds or more. Preferable conditions include a steel sheet temperature of not lower than ($Ac_3$ transformation temperature−10)° C. and a holding time of 150 seconds or more. From the viewpoint that the damage to a furnace body due to heat is significant when the temperature of an annealing furnace is excessively high, the upper limit of the steel sheet temperature during soaking is preferably 920° C. or lower.

Cooling at an average cooling rate of 20° C./s or more in a temperature range from ($Ac_3$ transformation temperature−20)° C. to the Ms transformation temperature In order to allow martensite transformation to proceed predominantly, cooling is performed at an average cooling rate of 20° C./s or more from a steel sheet temperature of ($Ac_3$ transformation temperature−20)° C. to the Ms transformation temperature. The average cooling rate is Preferably 30° C./s or more. However, the average cooling rate is preferably 150° C./s or less from the viewpoint that the temperature variation in the steel sheet is reduced and operational control is easy.

Further cooling to a temperature of below (Ms transformation temperature−200)° C.

In the annealing step, further cooling is performed to a temperature of below (Ms transformation temperature 200)° C. When the cooling stop temperature is not lower than (Ms transformation temperature−200)° C., martensite transformation is not completed and the austenite phase remains, thereby causing the increase of the untempered martensite phase and the retained austenite phase. In the annealing step, the cooling rate in a temperature range lower than the Ms transformation temperature is not particularly limited. Subsequently to cooling after the above soaking, cooling is preferably performed at an average cooling rate of 20° C./s to 30° C./s in a temperature range from the Ms transformation temperature to (Ms transformation temperature−200)° C.

(Tempering Step)

Reheating in a temperature range from 400° C. to 600° C. under such conditions that the heating time corresponding to 500° C. is 60 seconds or more In the present disclosure, conditions for tempering the formed martensite phase are controlled in addition to the control of an alloying element, whereby the strength of the steel sheet is controlled. The hardness of the tempered martensite phase is governed by the heating time and temperature of the steel sheet. Therefore, the hardness of the tempered martensite phase can be steadily controlled by the time corresponding to 500° C. using a tempering parameter. The hardness and ductility of the martensite phase are in a trade-off relationship and therefore the reduction in hardness thereof increases the ductility thereof. Thus, the ductility of the tempered martensite phase controlled to a desired hardness is required in the present disclosure. In order to set the Vickers hardness of the tempered martensite phase to 280 to 340, the heating time corresponding to 500° C. in a temperature range from 400° C. to 600° C. is set to 60 seconds or more. In order to prevent excessive softening, the heating time is preferably set to 150 seconds or less. On the other hand, in an actual process, the temperature varies continuously. Therefore, in order to determine the heating time corresponding to 500° C., the temperature is measured at 1 second intervals. The heating time corresponding to 500° C. is determined from the temperature by Formula (1). T is the measured temperature (° C.); $t_i$ is the heating time (s), corresponding to 500° C., determined from the temperature (T) measured at 1 second intervals; $t_{total}$ is the cumulative heating time (s), corresponding to 500° C., determined by Formula (1); and n represents the number of times the temperature is measured at 1 second intervals.

[Math. 1]

$$\frac{t_i}{3600} = \left(\frac{1}{3600}\right)^{(T+273)/773} \times 10^{20\frac{T-500}{773}} \quad (1)$$

-continued $$t_{Total} = \sum_{1}^{n} t_i \quad (2)$$

(Hot Dipping Step)

When the manufactured steel sheet is a hot-dip coated steel sheet, a hot dipping step is performed in a continuous coating line after the tempering step. In the hot dipping step, a coated layer is preferably applied to the steel sheet in such a manner that the steel sheet is immersed in a plating bath which has a composition containing Fe: 5.0% to 20.0% and Al: 0.001% to 1.0% and further containing one or more selected from Pb, Sb, Si, Sn, Mg, Mn, Ni, Cr, Co, Ca, Cu, Li, Ti, Be, Si, and an REM totaling 0% to 3.5%, the remainder being Zn and inevitable impurities, and which has a temperature of 460° C. Alloying is preferably performed in such a manner that the coated layer is alloyed by heating to 500° C. to 600° C. after the hot dipping step.

The hot dipping step is further described. The coated layer is preferably applied to the steel sheet in such a manner that the steel sheet is immersed in a plating bath in which the coating composition is Zn-0.13 mass percent. Al and which has a temperature of 460° C. Alloying is preferably performed in such a manner that the coated layer is alloyed by heating to 500° C. to 600° C. after the hot dipping step.

EXAMPLES

Each of 250 mm thickness steels having a composition shown in Table 1 was rolled into a hot-rolled steel plate under hot rolling step conditions (rough rolling conditions are omitted) shown in Table 2 and the hot-rolled steel plate was cold-rolled at a rolling reduction of 40% to 65% so as to have a thickness of 1.0 mm to 2.0 mm, was treated in a continuous annealing line or a continuous hot-dipping line under annealing step conditions shown in Table 2, and was then tempered under tempering step conditions shown in Table 2, whereby a cold-rolled steel sheet was obtained. Incidentally, the average cooling rate in the hot rolling step in Table 2 is the average cooling rate from the finishing delivery temperature to 580° C. The average cooling rate shown in the average cooling rate*4 after soaking was maintained in a temperature range from the Ms transformation temperature to (Ms transformation temperature−200)° C. in an annealing step, followed by cooling to the cooling stop temperature shown in Table 2. The $Ac_1$ temperature and the $Ac_3$ temperature were obtained from a transformation expansion curve obtained at an average heating rate of 3° C./s using a thermal dilatometer. The Ms transformation temperature was obtained from a transformation expansion curve obtained at an average cooling rate of 60° C./s from the $Ac_3$ temperature to 300° C. after heating to not lower than the $Ac_3$ temperature using the thermal dilatometer.

In the case of manufacturing a GI material or a GA material, the tempered cold-rolled steel sheet was further subjected to a hot dipping step (in the case of the GA material, further an alloying step), whereby a hot-dip coated steel sheet was obtained. A "bare material" including no coated layer on a surface thereof was manufactured in a continuous annealing line. A "GI material" including a galvanizing layer or a "GA material" including a galvannealing layer was manufactured in a continuous hot-dipping line. Manufacturing conditions are as shown in Table 2. The temperature of a plating bath (coating composition: Zn-0.13 mass percent Al) used in the continuous hot-dipping line was 460° C. The coating weight per single side of each of the GI material and the GA material was 45 g/m$^2$ to 65 g/m$^2$.

Test specimens were taken from the cold-rolled steel sheet or hot-dip coated steel sheet obtained as described above and were evaluated by methods below.

(i) Microstructural Observation

The area fraction of each phase was evaluated by a method below. A test specimen was cut out of the cold-rolled steel sheet or the hot-dip coated steel sheet such that a cross section in parallel to a rolling direction was an observation surface. The cross section was corroded with 1% nital and was revealed. The microstructure of a through-thickness central portion was photographed in 10 fields of view at a magnification of 2,000 times using a scanning electron microscope. A ferrite phase is a microstructure having morphology in which no corrosion mark or cementite is observed in a grain. Tempered martensite is a microstructure in which a corrosion mark and cementite are observed in a grain. An untempered martensite phase is a microstructure in which no cementite is observed in a grain and which is observed with lighter contrast as compared to a ferrite phase. For these phases, the average of area fractions with respect to observation fields of view was determined by image analysis. When a bainite phase, pearlite, or the like is contained, the bainite phase, pearlite, or the like is separated from phases other than the ferrite phase, the tempered martensite phase, and the untempered martensite phase and an area fraction of the bainite phase, pearlite, or the like with respect to observation fields of view may be determined.

(ii) X-Ray Measurement

A base steel sheet of the cold-rolled steel sheet or the hot-dip coated steel sheet was ground to a one-fourth position in a thickness direction. The volume fraction of a retained austenite phase was determined from the X-ray diffraction intensity of a surface of the sheet chemically polished by 200 μm or more. An incident radiation source used was a Mo Kα radiation and $(200)_\alpha$, $(211)_\alpha$, $(200)_\gamma$, $(220)_\gamma$, and $(311)_\gamma$ peaks were measured. The obtained value of the volume fraction of the retained austenite phase was defined as the value of the area fraction of a steel sheet microstructure.

(iii) Tensile Test

A JIS No. 5 tensile specimen was prepared from the cold-rolled steel sheet or the hot-dip coated steel sheet in a direction perpendicular to the rolling direction and was subjected to a tensile test five times in accordance with JIS Z 2241 (2011) standards, whereby the average yield strength (YS), tensile strength (TS), and total elongation (El) were determined. The cross-head speed of the tensile test was 10 mm/min.

A tensile strength (TS) of 950 MPa to 1,120 MPa, a yield strength (YS) of 750 MPa or more, and a total elongation (El) of 14% or more were acceptable.

(iv) Vickers Hardness Test

A tempered martensite phase was repeatedly measured with a test force of 3 of using a Vickers hardness tester ten times. The Vickers hardness was determined in such a manner that the two diagonal lengths ($d_1$, $d_2$ (μm)) of each indentation were measured with a scanning electron microscope and were substituted into Formula (3). In this operation, an indentation across ferrite was excluded. The case where the average of hardness measurements was 280 to 340 was acceptable.

[Math. 2]

$$\text{Vickers hardness} = \frac{5.56 \times 10^3}{d_1 \times d_2} \tag{3}$$

(v) Hole-Expanding Test

The center of a 100 mm wide, 100 mm long sample was punched with a clearance of 12% at a diameter of 10 mm in accordance with JIS Z 2256 and was tested using a truncated conical punch with a top angle of 60° five times in total. Five measurements of the hole expansion ratio (λ) given by Formula (4) were averaged. A hole expansion ratio of 75% or more was acceptable.

$$\text{(Hole expansion ratio)} = \text{(tested hole diameter} - \text{initial hole diameter(=10 mm))/(initial hole diameter)} \times 100 \tag{4}$$

Results obtained as described above are shown in Table 3.

In Table 1, the content of each preferable contained element is described in the column "Others". In Table 1, the remainder other than shown elements are Fe and inevitable impurities.

TABLE 1

| Steel | Composition (mass percent) | | | | | | | | | | |
|---|---|---|---|---|---|---|---|---|---|---|---|
| No. | C | Si | Mn | P | S | Al | N | Ti | B | Others | Remarks |
| A | 0.11 | 1.5 | 2.6 | 0.01 | 0.001 | 0.04 | 0.0043 | 0.03 | 0.0012 | — | Inventive example |
| B | 0.15 | 1.0 | 2.8 | 0.01 | 0.002 | 0.03 | 0.0030 | 0.02 | 0.0015 | — | Inventive example |
| C | 0.12 | 1.2 | 3.2 | 0.01 | 0.003 | 0.05 | 0.0034 | 0.02 | 0.0011 | V: 0.05 | Inventive example |
| D | 0.14 | 1.3 | 2.9 | 0.01 | 0.001 | 0.04 | 0.0037 | 0.04 | 0.0012 | Mo: 0.15<br>REM: 0.002<br>Sn: 0.001 | Inventive example |
| E | 0.13 | 1.5 | 3.1 | 0.01 | 0.003 | 0.04 | 0.0042 | 0.03 | 0.0015 | V: 0.02<br>Mo: 0.05<br>Mg: 0.002<br>Ca: 0.001 | Inventive example |
| F | 0.10 | 1.4 | 3.2 | 0.02 | 0.002 | 0.03 | 0.0042 | 0.02 | 0.0015 | Sb: 0.002 | Inventive example |
| G | 0.02 | 1.4 | 2.9 | 0.01 | 0.003 | 0.03 | 0.0041 | 0.03 | 0.0012 | — | Comparative example |
| H | 0.15 | 2.5 | 2.6 | 0.01 | 0.002 | 0.03 | 0.0042 | 0.02 | 0.0015 | — | Comparative example |
| I | 0.11 | 1.4 | 2.6 | 0.02 | 0.001 | 0.05 | 0.0031 | 0.02 | <0.0002 | — | Comparative example |

TABLE 2

| Steel Sheet No. | Steel No. | Hot rolling step: Steel heating temperature (° C.) | Finishing delivery temperature (° C.) | Average cooling rate (° C./s) | Coiling temperature (° C.) | Annealing step: $Ac_1$ transformation temperature (° C.) | $Ac_3$ transformation temperature (° C.) | Ms transformation temperature (° C.) | Average heating rate (° C./s)*1 | Holding time during heating (seconds)*2 |
|---|---|---|---|---|---|---|---|---|---|---|
| 1 | A | 1240 | 880 | 45 | 460 | 711 | 857 | 446 | 1.5 | 72 |
| 2 | | 1210 | 880 | 70 | 520 | | | | 1.3 | 178 |
| 3 | | 1200 | 860 | 55 | 520 | | | | 1.1 | 167 |
| 4 | | 1210 | 860 | 45 | 650 | | | | 0.9 | 136 |
| 5 | | 1220 | 860 | 65 | 550 | | | | 5.8 | 76 |
| 6 | | 1240 | 870 | 35 | 480 | | | | 1.1 | 20 |
| 7 | | 1250 | 850 | 60 | 400 | | | | 1.8 | 76 |
| 8 | | 1230 | 890 | 45 | 480 | | | | 2.0 | 194 |
| 9 | | 1200 | 890 | 45 | 520 | | | | 1.6 | 210 |
| 10 | | 1230 | 910 | 40 | 400 | | | | 2.0 | 85 |
| 11 | B | 1220 | 890 | 70 | 450 | 703 | 836 | 426 | 1.9 | 216 |
| 12 | | 1220 | 910 | 60 | 540 | | | | 1.6 | 260 |
| 13 | | 1200 | 860 | 40 | 500 | | | | 1.8 | 268 |
| 14 | C | 1250 | 900 | 50 | 400 | 707 | 858 | 422 | 0.8 | 168 |
| 15 | | 1220 | 890 | 50 | 530 | | | | 1.6 | 227 |
| 16 | | 1230 | 890 | 50 | 440 | | | | 1.4 | 131 |
| 17 | D | 1210 | 870 | 60 | 470 | 708 | 850 | 424 | 1.5 | 206 |
| 18 | E | 1230 | 860 | 70 | 450 | 711 | 863 | 419 | 1.8 | 113 |
| 19 | F | 1230 | 880 | 70 | 470 | 711 | 868 | 429 | 1.2 | 261 |
| 20 | G | 1250 | 860 | 60 | 400 | 713 | 881 | 473 | 1.4 | 113 |
| 21 | H | 1220 | 850 | 55 | 410 | 725 | 879 | 423 | 1.1 | 253 |
| 22 | I | 1200 | 890 | 50 | 540 | 709 | 854 | 447 | 1.0 | 108 |

| Steel Sheet No. | Steel No. | Annealing step: Maximum attained temperature (° C.) | Holding time during soaking (seconds)*3 | Average cooling rate (° C./s)*4 | Cooling stop temperature (° C.) | Tempering step Reheating time (seconds)*5 | Alloying step Alloying temperature (° C.) | Remarks |
|---|---|---|---|---|---|---|---|---|
| 1 | A | 845 | 172 | 24 | 176 | 121 | — | Inventive example |
| 2 | | 856 | 161 | 27 | 189 | 73 | — | Inventive example |
| 3 | | 857 | 141 | 22 | 190 | 107 | 540 | Inventive example |
| 4 | | 852 | 164 | 31 | 180 | 71 | 540 | Comparative example |
| 5 | | 844 | 162 | 28 | 184 | 102 | 520 | Comparative example |
| 6 | | 841 | 135 | 25 | 186 | 136 | 530 | Comparative example |
| 7 | | 843 | 50 | 30 | 186 | 105 | 550 | Comparative example |
| 8 | | 855 | 135 | 5 | 188 | 131 | 540 | Comparative example |
| 9 | | 844 | 136 | 32 | 260 | 106 | 530 | Comparative example |
| 10 | | 851 | 137 | 31 | 171 | 20 | — | Comparative example |
| 11 | B | 841 | 138 | 25 | 172 | 78 | — | Inventive example |
| 12 | | 847 | 139 | 22 | 190 | 71 | — | Inventive example |
| 13 | | 853 | 140 | 29 | 180 | 100 | 580 | Inventive example |
| 14 | C | 859 | 141 | 29 | 181 | 112 | — | Inventive example |
| 15 | | 843 | 142 | 33 | 182 | 139 | — | Inventive example |
| 16 | | 840 | 143 | 32 | 181 | 102 | 570 | Inventive example |
| 17 | D | 845 | 144 | 23 | 185 | 141 | 590 | Inventive example |
| 18 | E | 852 | 145 | 30 | 172 | 69 | 580 | Inventive example |
| 19 | F | 851 | 146 | 29 | 172 | 87 | 580 | Inventive example |
| 20 | G | 861 | 147 | 25 | 187 | 68 | 540 | Comparative example |
| 21 | H | 860 | 148 | 27 | 190 | 92 | 560 | Comparative example |
| 22 | I | 851 | 149 | 27 | 176 | 107 | 550 | Comparative example |

*1The average heating rate in a temperature range from ($Ac_1$ transformation temperature +10)° C. to ($Ac_3$ transformation temperature −20)° C.

*2The holding time in a temperature range from ($Ac_1$ transformation temperature +10)° C. to ($Ac_3$ transformation temperature −20)° C.

*3The holding time in a temperature range not lower than ($Ac_3$ transformation temperature −20)° C.

*4The average cooling rate in a temperature range from ($Ac_3$ transformation temperature −20)° C. to the Ms transformation temperature.

*5The holding time in a temperature range from 400° C. to 600° C. in terms of 500° C.

TABLE 3

| Steel Sheet No. | Coated or uncoated*6 | Microstructure of steel sheet: Area fraction of ferrite phase (%) | Area fraction of tempered martensite phase (%) | Area fraction of untempered martensite phase (%) | Area fraction of retained austenite phase (%) | Vickers hardness of tempered martensite phase | Mechanical properties of steel sheet: Yield strength (MPa) | Tensile strength (MPa) | Total elongation (%) | Hole expansion ratio (%) | Remarks |
|---|---|---|---|---|---|---|---|---|---|---|---|
| 1 | Bare steel | 3 | 93 | 1 | 3 | 300 | 827 | 985 | 15.7 | 97 | Inventive example |
| 2 | GI steel | 4 | 92 | 1 | 3 | 302 | 785 | 981 | 14.5 | 101 | Inventive example |
| 3 | GA steel | 5 | 91 | 0 | 4 | 302 | 776 | 958 | 15.0 | 96 | Inventive example |
| 4 | GA steel | 35 | 59 | 2 | 4 | 368 | 659 | 915 | 16.5 | 45 | Comparative example |
| 5 | GA steel | 28 | 65 | 4 | 3 | 361 | 672 | 921 | 16.1 | 48 | Comparative example |
| 6 | GA steel | 31 | 61 | 5 | 3 | 365 | 675 | 925 | 14.2 | 44 | Comparative example |
| 7 | GA steel | 45 | 45 | 5 | 5 | 355 | 659 | 983 | 15.3 | 51 | Comparative example |
| 8 | GA steel | 91 | 0 | 9 | 0 | — | 391 | 521 | 15.8 | 73 | Comparative example |
| 9 | GA steel | 8 | 65 | 20 | 7 | 348 | 823 | 991 | 15.6 | 25 | Comparative example |
| 10 | Bare steel | 8 | 89 | 1 | 2 | 355 | 952 | 1161 | 10.2 | 38 | Comparative example |
| 11 | Bare steel | 0 | 96 | 2 | 2 | 328 | 874 | 1041 | 15.6 | 80 | Inventive example |
| 12 | GI steel | 4 | 93 | 1 | 2 | 314 | 838 | 1035 | 14.4 | 83 | Inventive example |
| 13 | GA steel | 7 | 90 | 1 | 2 | 307 | 821 | 1001 | 15.0 | 100 | Inventive example |
| 14 | Bare steel | 3 | 92 | 2 | 3 | 315 | 839 | 1049 | 15.6 | 93 | Inventive example |
| 15 | GI steel | 0 | 96 | 0 | 4 | 324 | 883 | 1051 | 15.2 | 95 | Inventive example |
| 16 | GA steel | 1 | 95 | 1 | 3 | 307 | 853 | 1015 | 14.5 | 94 | Inventive example |
| 17 | GA steel | 3 | 93 | 0 | 4 | 320 | 830 | 1025 | 14.2 | 95 | Inventive example |
| 18 | GA steel | 0 | 97 | 1 | 2 | 317 | 824 | 1005 | 14.5 | 83 | Inventive example |
| 19 | GA steel | 1 | 94 | 1 | 4 | 294 | 792 | 954 | 14.6 | 89 | Inventive example |
| 20 | GA steel | 99 | 0 | 1 | 0 | — | 404 | 481 | 37.6 | 158 | Comparative example |
| 21 | GA steel | 45 | 36 | 11 | 8 | 346 | 671 | 987 | 18.6 | 25 | Comparative example |
| 22 | GA steel | 34 | 54 | 6 | 6 | 279 | 644 | 934 | 18.1 | 61 | Comparative example |

*6"Bare steel" refers to an unplaled cold-rolled steel sheet. "GI steel" refers to a steel sheet including a galvanizing layer. "GA steel" refers to a steel sheet including a galvannealing layer.

Every inventive example had high strength with a tensile strength TS of 950 MPa to 1,120 MPa, and was excellent in stretch flangeability. Furthermore, the inventive examples were steel sheets excellent in yield strength and total elongation. The inventive examples were steel sheets, which had high strength, excellent in formability. However, comparative examples outside the scope of the present disclosure, particularly comparative examples having no desired ferrite phase area fraction or tempered martensite phase area fraction, had a strength of less than 950 MPa or were deteriorated in stretch flangeability. Comparative examples in which the hardness of tempered martensite was outside the scope of the present disclosure were deteriorated in total elongation and stretch flangeability.

The invention claimed is:

1. A high-strength steel sheet having a composition comprising:

C: 0.09% to 0.17%, by mass %;

Si: 0.6% to 1.7%, by mass %;

Mn: 3.5% or less, by mass %;

P: 0.03% or less, by mass %;

S: 0.005% or less, by mass %;

Al: 0.08% or less, by mass %;

N: 0.006% or less, by mass %;

Ti: 0.05% or less, by mass %;

B: 0.0002% to 0.0030%, by mass %; and

Fe and inevitable impurities, wherein:

the steel sheet has a microstructure containing:

less than 20% (including 0%) of a ferrite phase,

75% or more of a tempered martensite phase, which has a Vickers hardness of 280 to 340, 10% or less (including 0%) of an untempered martensite phase, and 2% or more and less than 5% of a retained austenite phase each phase expressed in terms of area fraction, and the steel sheet has a tensile strength in a range of from 950 MPa to 1,120 MPa.

2. The high-strength steel sheet according to claim 1, wherein the composition further comprises at least one element selected from at least one of group I and group II:

group I: V: 0.01% to 0.1% and Mo: 0.01% to 0.2%, by mass %, and group II: one or more selected from an REM, Sn, Sb, Mg, and Ca totaling 0.1% or less, by mass %.

3. The high-strength steel sheet according to claim 1, wherein Mn is present in an amount of 2.9% to 3.5%, by mass %.

4. The high-strength steel sheet according to claim 1, wherein the high-strength steel sheet is a hot-dip coated steel sheet or an alloyed hot-dip coated steel sheet.

5. The high-strength steel sheet according to claim 2, wherein the high-strength steel sheet is a hot-dip coated steel sheet or an alloyed hot-dip coated steel sheet.

6. A method for manufacturing the high-strength steel sheet according to claim 1, the method comprising:

a hot rolling process including:

heating steel having the composition to a temperature in a range of from 1,100° C. to 1,350° C., hot rolling the steel, including rough rolling and finish rolling, and coiling the steel at a coiling temperature of 580° C. or lower after finish rolling at a finishing delivery temperature of 800° C. or higher;

a cold rolling process including cold rolling the steel;

an annealing process including:

heating the steel at an average heating rate of 2.0° C./s or less in a temperature range of from ($Ac_1$ transformation temperature+10) ° C. to ($Ac_3$ transformation temperature−20) ° C., holding for 60 seconds or more in the temperature range of from ($Ac_1$ transformation temperature+10) ° C. to ($Ac_3$ transformation temperature−20) ° C., and holding for 120 seconds or more in a temperature range that is not lower than ($Ac_3$ transformation temperature−20) ° C., cooling the steel at an average cooling rate of 20° C./s or more in a temperature range of from ($Ac_3$ transformation temperature−20) ° C. to the Ms transformation temperature, and further cooling the steel to a temperature below (Ms transformation temperature−200) ° C.; and a tempering process including reheating the steel in a temperature range of from 400° C. to 600° C. under conditions such that heating corresponding to 500° C. is performed for 60 seconds or more.

7. The method for manufacturing the high-strength steel sheet according to claim 6, further comprising hot dipping the steel.

8. The method for manufacturing the high-strength steel sheet according to claim 7, further comprising alloying the steel.

9. A method for manufacturing the high-strength steel sheet according to claim 2, the method comprising:

a hot rolling process including:

heating steel having the composition to a temperature in a range of from 1,100° C. to 1,350° C., hot rolling the steel, including rough rolling and finish rolling, and coiling the steel at a coiling temperature of 580° C. or lower after finish rolling at a finishing delivery temperature of 800° C. or higher;

a cold rolling process including cold rolling the steel;

an annealing process including:

heating the steel at an average heating rate of 2.0° C./s or less in a temperature range of from ($Ac_1$ transformation temperature+10) ° C. to ($Ac_3$ transformation temperature−20) ° C., holding for 60 seconds or more in the temperature range of from ($Ac_1$ transformation temperature+10) ° C. to ($Ac_3$ transformation temperature−20) ° C., holding for 120 seconds or more in a temperature range that is not lower than ($Ac_3$ transformation temperature−20) ° C., cooling the steel at an average cooling rate of 20° C./s or more in a temperature range of from ($Ac_3$ transformation temperature−20) ° C. to the Ms transformation temperature, and further cooling the steel to a temperature below (Ms transformation temperature−200) ° C.; and a tempering process including reheating the steel in a temperature range of from 400° C. to 600° C. under conditions such that heating corresponding to 500° C. is performed for 60 seconds or more.

10. The method for manufacturing the high-strength steel sheet according to claim 9, further comprising hot dipping the steel.

11. The method for manufacturing the high-strength steel sheet according to claim 10, further comprising alloying the steel.

* * * * *